US005364417A

United States Patent [19]

Wenstrup et al.

[11] Patent Number: 5,364,417

[45] Date of Patent: Nov. 15, 1994

[54] METHOD OF DYEING NYLON FIBER WITH ACID DYE: SULLFAMIC ACID

[75] Inventors: David E. Wenstrup, Easley; Sammy L. Roe, Wellford, both of S.C.

[73] Assignee: Milliken Research Corporation, Spartanburg, S.C.

[21] Appl. No.: 976,946

[22] Filed: Nov. 16, 1992

[51] Int. Cl.[5] ..... C09B 67/00

[52] U.S. Cl. ..... 8/592; 8/587; 8/680; 8/924; 562/37

[58] Field of Search ..... 8/592, 680

[56] References Cited

U.S. PATENT DOCUMENTS 2,499,787 3/1950 Sharkey ..... 8/636
4,129,416 12/1978 Bennett et al. ..... 8/115
4,285,691 9/1981 Egli et al. ..... 8/455
4,411,665 10/1983 Egli et al. ..... 8/455
4,415,331 11/1983 Dusenbury et al. ..... 8/114.6

FOREIGN PATENT DOCUMENTS 893500 12/1982 Belgium .
2257989 1/1993 United Kingdom .

*Primary Examiner*—A. Lionel Clingman
*Attorney, Agent, or Firm*—Terry T. Moyer; Timothy J. Monahan

[57] ABSTRACT

A process for dyeing nylon with acid or premetallized acid dyes is provided wherein the dye bath is brought to a temperature of 160°-230° F. and a pH of 5.5-4.0, followed by the gradual addition of sulfamic acid to lower the pH to 3.75-2.25, thereby improving dye exhaustion.

14 Claims, No Drawings

METHOD OF DYEING NYLON FIBER WITH ACID DYE: SULLFAMIC ACID

BACKGROUND OF THE INVENTION

This invention relates to an improved process for exhaust dyeing nylon textiles.

Nylon fiber is commonly dyed with acid dyes, including premetallized acid dyes, in a batch process referred to as exhaust dyeing. For example, nylon fiber which has been made into fabric may be dyed in a jet-dyeing machine, whereby a continuous loop of the fabric is circulated throughout the dye bath by impinging the dye bath liquor against the fabric in a venturi nozzle.

Care must be taken during the dyeing process to obtain a uniform distribution of dye on the fabric, referred to as leveling. One method of improving leveling is to incorporate leveling agents which retard the dye uptake. Another method is to gradually raise the temperature of the dye bath by about 1° to 2° F. per minute from a starting temperature of approximately 90° F. to a dye temperature of approximately 200° F. The rise in temperature causes the fiber structure to open up and increases diffusion and migration of the dye.

The pH of the dye bath is a critical factor in dyeing nylon with acid dyes and has a profound effect on the dye strike rate. At low pH, the acid functionality of the dye reacts with the activated amino groups of the polyamide, to form a salt. Generally, the pH at the beginning of the dye cycle is neutral and is slowly decreased during the dye cycle. The pH of the dye bath is controlled by one or more of the following techniques: use of buffers; gradual addition of mild acids, such as acetic acid during the heating cycle; and use of diesters which hydrolyze in the presence of water, especially at higher temperatures, to form an acid.

It is desirable to lower the pH to 3.5 or less during the dye cycle to maximize dye exhaustion. However, it is very difficult to achieve pH levels below 4.0 without losing control of the dye strike rate, thereby causing variations in dye coverage on the fabric. The pH control is especially necessary with premetallized dyes because of their greater reactivity. While the use of mild acids and diesters is successful in achieving level dyeing, they are not effective in lowering the pH much below 4.5.

Therefore, while the objectives of uniform dye application on fabric has been met by the aforementioned methods, the degree of dye exhaustion has not been satisfactory. Incomplete exhaustion of the dye is reflected in increased raw material costs, since excess dye must be used in each cycle; greater rinsing to remove residual, unreacted dye; and a burden placed on waste water treatment systems to dispose of unreacted dyes.

SUMMARY OF THE INVENTION

Therefore, an object of the invention is to provide a process for exhaust dyeing nylon fiber which ensures level dyeing.

Another object of the invention is to provide a process with improved exhaustion of the dye from the dye bath.

Still another object of the invention is to provide a dyeing process which is not harmful to manufacturing equipment.

Accordingly, a process for dyeing nylon fiber with an acid dye in an aqueous dye bath is provided, wherein the dye bath is at a temperature between 160° F. and 230° F., and a pH of 5.5 to 4.0, and sulfamic acid is added to the dye bath to lower the pH to between 3.75 and 2.25. The acid is added gradually over a period of time to avoid variations in dye coverage.

Advantages of the present process resulting from improved exhaustion include a cost savings based upon approximately a 25% reduction in dye requirements, less rinsing following dyeing, and an overall decrease in dye sent with the dye bath and rinse water to waste treatment.

The process features the use of sulfamic acid which, although it is a relatively strong acid, has a low corrosion rate and is particularly compatible with standard jet-dyeing equipment used throughout the industry to dye nylon fabric. The sulfamic acid is added to the dye bath as a 1–25 wt. % aqueous solution.

DESCRIPTION OF THE PREFERRED EMBODIMENT OF THE INVENTION

Without limiting the scope of the invention, the preferred features of the invention are hereinafter set forth.

The present process is applicable to dyeing nylon fiber, which may be for example in the form of staple fiber, filament, yarn, knitted, woven or nonwoven fabric, or may be tufted or bonded to a substrate. As used throughout, the term "nylon" is intended as a generic term encompassing any long-chain, synthetic polyamide which has recurring amide groups as an integral part of its backbone, and can be formed into filaments. Of particular interest are nylon 6 and nylon 6,6.

The nylon fiber is dyed in an aqueous solution containing an acid dye. By way of example and not limitation, suitable acid dyes include those commonly referred to as slightly acid or neutral dyes such as Acid Orange 116, Acid Red 299, Acid Blue 62, Acid Red 138, Acid Red 52, Acid Violet 48 and Acid Blue 129. Another class of acid dyes which are useful herein include premetallized acid dyes, especially 1:2 premetallized dyes such as Acid Black 107, Acid Red 259, Acid Yellow 116, Acid Red 182 and Acid Yellow 232.

Dye auxiliaries may also be added to the dye bath. These dye auxiliaries include leveling agents such as anionic leveling agents which compete with positively charged dye sites on the fiber; cationic leveling agents which complex with the dye; and amphoteric leveling agents which can be anionic or cationic depending on the pH of the dye bath. Amphoteric leveling agents are particularly useful with premetallized dyes since the dye bath is often slightly alkaline at the start of the dyeing cycle. An example of a useful amphoteric leveling agent is Albegal B®, a trademark of Ciba-Geigy Corporation.

Additional commonly used auxiliaries are lubricants, defoamers and, where necessary, sequestrants to complex with contaminants such as copper and iron.

The pH at the start of the dye cycle is relatively high to control the dye strike rate, thus promoting level dyeing. The desired pH is dependent upon the dye used; a pH of 7–8 is recommended for premetallized dyes and a pH of 6.5 is recommended for most other acid dyes. The pH is adjusted slightly higher at the start of the dye cycle for nylon 6 as compared to nylon 6,6 type fibers, since nylon 6 has a greater affinity for most dyes. Depending on the type of acid-donor system used to adjust the pH, the dye bath may also contain a buffer system, for example, mono-, di- and trisodium phosphates or monosodium sulfate.

During the dye cycle, the temperature of the dye bath containing the nylon fiber, is gradually raised, typically at a rate of 1°-2° F. per minute. At the start of the cycle, the dye bath temperature is relatively low, for example 80°-120° F., preferably 90°-100° F., to avoid excessive dye strike rates which lead to non-uniform dyeing. As the dye temperature increases, the fiber structure opens to facilitate dye migration, increasing diffusion and enhancing leveling. Typical dyeing temperatures are between 160°-230° F., preferably 170°-220° F., with 175°-215° F. being most preferred.

As the temperature is gradually raised, the pH of the dye bath is gradually decreased by any of a number of techniques. For example, a mild acid, such as acetic acid, may be slowly introduced while the dye bath is heating. Alternatively, dibasic esters, such as "Sandacid®", a trademark of Sandoz Chemical Company, which hydrolyzes in the dye bath to form an acid, are employed. At higher temperatures, hydrolysis of the ester proceeds rapidly. Thus, the pH is lowered as the temperature is raised. The use of dibasic esters is especially useful with premetallized dyes because of their sensitivity to changes in pH levels.

Once the dye bath reaches the dyeing temperature, i.e. between 160° and 230° F. and a pH of 5.0-4.0, most of the dye in the dye bath has been exhausted. However, for the previously stated reasons, it is desirable to enhance dye exhaustion and utilization. Therefore, at this stage of the process, a second, stronger acid is slowly added to the dye bath to lower the pH to a level of 3.75 to 2.25, preferably 3.5 to 2.5. At a pH of less than 2.25, the fiber may be damaged or otherwise degraded.

The requirements of the second acid are that it has a pKa of less than 3.75, it is compatible with the dye bath system, is relatively noncorrosive, and can be introduced in a controlled manner without causing leveling problems. Sulfamic acid has been found to meet the above criteria. Formic acid and phosphoric acid are examples of additional acids which may be utilized. Although less desirable from the viewpoint of safety, handling and corrosion, hydrochloric acid, sulfuric acid and nitric acid may also be employed.

In a preferred embodiment, an aqueous solution of sulfamic acid is slowly added to the dye bath which is at the dye temperature and a pH of 5.0 to 4.0, preferably about 4.5. For example, a 2 wt. % solution of sulfamic acid may be employed. The recommended rate of addition is at a rate of less than 0.0001 pound of sulfamic acid per minute per pound of dye bath, preferably less than 0.00005 pound of sulfamic acid per minute per pound of dye bath.

After the desired pH level of the dye bath is reached by gradually adding sulfamic acid, typically over a 20-60 minute time period, the dye bath may be held for an additional time period to maximize dye exhaustion. Hold times of 5-30 minutes may be employed, although in the interest of minimizing cycle times, diminishing returns are observed after 10-20 minutes.

The next step of the dye cycle is to cool the dye bath to about 160° or less, preferably between 140°-160° F., followed by rinsing. Dye fixatives, such as phenolic resins, may be applied if desired. Last, the fabric is dried using techniques well known in the industry.

The invention may be further understood by reference to the following examples, but the invention is not to be construed as being unduly limited thereby. Unless otherwise indicated, all parts and percentages are by weight.

The following example represents the prior art technology for dyeing nylon fabric.

EXAMPLE A

Approximately 600 pounds of a nylon 6,6 fabric, weighing 5.0 oz/yd$^2$ and 800 gallons of dye liquor were placed in a standard, atmospheric jet dye machine. The aqueous dye liquor had the following composition:

| | |
|---|---|
| | Auxiliaries |
| 0.25% | monosodium phosphate |
| 0.50% | nonionic surfactants[1] |
| 0.50% | amphoteric polyglycol ether[2] |
| 1.25% | silicone and emulsifiers[3] |
| 3.00% | nonionic polyamide derivative[4] |
| | Dyes |
| 0.70% | Neolan Red E-XB 400% |
| 0.25% | Polar Br. Red 3BN (Acid Red 131) 140% |
| | Acid/Buffers |
| 0.1 g/l | soda ash |
| 2.0 g/l | heterocyclic dibasic ester[5] |
| 1 | Leveler 915 TM, Milliken Chemical |
| 2 | Albegal A TM, Ciba-Geigy |
| 3 | Barfoamkil TM, Appollo |
| 4 | Lurotex A25 TM, BASF Chemical |
| 5 | Sandacid VS TM, Sandoz Chemical |

The temperature was gradually raised from 90° F. to 180° F. to produce the time, temperature and pH profile shown in Table I below.

TABLE I

| Time (Minutes) | Temperature | pH |
|---|---|---|
| 0 | 90° F. | 6.5 |
| 20 | 110° F. | 5.8 |
| 30 | 120° F. | 5.2 |
| 40 | 130° F. | 4.9 |
| 50 | 140° F. | 4.7 |
| 60 | 150° F. | 4.5 |
| 70 | 160° F. | 4.2 |
| 80 | 170° F. | 4.0 |
| 90 | 180° F. | 4.0 |
| 95 | 180° F. | 4.0 |

Next, the temperature of the dye liquor was lowered to about 150° F. and sampled. Sufficient dyestuff remained in the liquor to make a dyeing equal to 15-20% of initial shade of undyed fabric.

The fabric was then rinsed and removed from the jet dye machine. The fabric was dyed a uniform red color.

EXAMPLE B

A standard let dye machine was charged with the fabric and dye liquor composition described in Example A with the exception that the dye liquor composition had the following dye concentration:*

0.550% Neolan Red E-XB 400%

0.178% Polar Br. Red 3BN (Acid Red 131) 140%

(* approximately 23% less dye)

The temperature was gradually raised from 90° F. to 180° F. accordingly to produce the same time, temperature and pH profile set out in Example A, which is reproduced in Table II below.

TABLE II

| Time (Minutes) | Temperature | pH |
|---|---|---|
| 0 | 90° F. | 6.5 |
| 20 | 110° F. | 5.8 |
| 30 | 120° F. | 5.2 |
| 40 | 130° F. | 4.9 |

TABLE II-continued

| Time (Minutes) | Temperature | pH |
|---|---|---|
| 50 | 140° F. | 4.7 |
| 60 | 150° F. | 4.5 |
| 70 | 160° F. | 4.2 |
| 80 | 170° F. | 4.0 |
| 90 | 180° F. | 4.0 |
| 95 | 180° F. | 4.0 |

However, at the end of the 95 minutes, sulfamic acid was gradually added to the dye liquor composition, which was held at 180° F., to produce the profile shown in Table III below.

TABLE III

| Time (Minutes) | Temperature | pH |
|---|---|---|
| 100 | 180° F. | 3.90 |
| 105 | 180° F. | 3.70 |
| 110 | 180° F. | 3.50 |
| 115 | 180° F. | 3.30 |
| 120 | 180° F. | 3.10 |
| 125 | 180° F. | 2.90 |
| 130 | 180° F. | 2.75 |
| 135 | 180° F. | 2.60 |
| 140 | 180° F. | 2.55 |

At the end of 140 minutes, the dye liquor temperature was lowered to about 150° F. and the liquor was sampled. There was only enough dyestuff remaining to tint an undyed fabric. The dye was exhausted from the liquor.

The fabric was then rinsed and removed from the jet dye machine. The fabric was dyed a uniform red color, with no visual shade difference from the fabric of Example A.

There are, of course, many alternative embodiments and modifications which are intended to be included within the scope of the following claims.

What we claim is:

1. In a process for dyeing nylon fiber with an acid dye in an aqueous dye bath, having a first step of bringing said dye bath to a pH of between 5.5 and 4.0, and a temperature of between 160° F. and 230° F., an improvement comprising a second step of adding sulfamic acid to said dye bath to lower the pH of said dye bath to between 3.75 and 2.25.

2. The process of claim 1 wherein the pH of said dye bath is lowered by addition of sulfamic acid to between 3.5 and 2.5.

3. The process according to claim 2 wherein nylon fiber is in the form of a knitted or woven fabric.

4. The process according to claim 3 wherein said process is performed in a jet-dyeing machine.

5. The process of claim 1 wherein said sulfamic acid is added to said dye bath at a rate of less than 0.0001 pound of sulfamic acid per minute per pound of dye bath solution.

6. The process of claim 5 wherein said temperature is between 175° and 200° F. while said sulfamic acid is added to said dye bath.

7. The process of claim 6 wherein the pH of said dye bath is lowered by addition of sulfamic acid to between 3.5 and 2.5.

8. The process according to claim 7 wherein nylon fiber is in the form of a knitted or woven fabric.

9. The process according to claim 8 wherein said process is performed in a jet-dyeing machine.

10. In a process for dyeing nylon fiber with an acid dye in an aqueous dye bath, having a first step of bringing said dye bath to a pH of between 5.5 and 4.0. and a temperature of between 160° F. and 230° F., an improvement comprising a second step of adding sulfamic acid to said dye bath at a rate of less than 0.00005 pounds of sulfamic acid per minute per pound of said dye bath, to lower the pH of said dye bath to between 3.75 and 2.25.

11. The process of claim 10 wherein said temperature is between 175° and 200° F. while said sulfamic acid is added to said dye bath.

12. The process of claim 10 wherein the pH of said dye bath is lowered by addition of sulfamic acid to between 3.5 and 2.5.

13. The process according to claim 12 wherein nylon fiber is in the form of a knitted or woven fabric.

14. The process according to claim 13 wherein said process is performed in a jet-dyeing machine.

* * * * *

UNITED STATES PATENT AND TRADEMARK OFFICE

CERTIFICATE OF CORRECTION

PATENT NO. : 5,364,417

DATED : November 15, 1994

INVENTOR(S) : David Edward Wenstrup and Sammy Luther Roe

It is certified that error appears in the above-identified patent and that said Letters Patent is hereby corrected as shown below:

On the title page, item [54] and in column 1, line 3, in the title delete "SULLFAMIC" and insert --SULFAMIC--.

Signed and Sealed this

Fourteenth Day of February, 1995

*Attest:*

*Attesting Officer*

BRUCE LEHMAN

*Commissioner of Patents and Trademarks*